US012013175B2

(12) United States Patent
Karanjikar et al.

(10) Patent No.: US 12,013,175 B2
(45) Date of Patent: Jun. 18, 2024

(54) REFRIGERATOR AND SHELVING SYSTEM FOR A REFRIGERATOR

(71) Applicant: WHIRLPOOL CORPORATION, Benton Harbor, MI (US)

(72) Inventors: Anant Karanjikar, St. Joseph, MI (US); Umakant Suresh Katu, Glen Allen, VA (US); Kailash Shravan More, Pune (IN); Sunil Patil, Belagavi (IN); Vinay M. Patil, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/332,932

(22) Filed: Jun. 12, 2023

(65) Prior Publication Data

US 2023/0324110 A1 Oct. 12, 2023

Related U.S. Application Data

(63) Continuation of application No. 17/580,989, filed on Jan. 21, 2022, now Pat. No. 11,740,012.

(51) Int. Cl.
*F25D 25/02* (2006.01)

(52) U.S. Cl.
CPC ..... *F25D 25/02* (2013.01); *F25D 2325/021* (2013.01); *F25D 2325/022* (2013.01)

(58) Field of Classification Search
CPC ..... F25D 25/02; F25D 2325/021; F25D 2325/022; F25D 25/027; F25D 25/024; F25D 25/04; F25D 2331/803; F25D 2331/809; F25D 23/067; F25D 25/021; A47B 46/005; A47B 96/025
See application file for complete search history.

(56) References Cited

U.S. PATENT DOCUMENTS

| | | | | | |
|---|---|---|---|---|---|
| 876,159 | A | | 1/1908 | Erickson | |
| 1,247,367 | A | | 11/1917 | Burchell | |
| 1,345,194 | A | | 6/1920 | Johnson | |
| 2,492,697 | A | * | 12/1949 | Higley | A47B 88/80 312/319.2 |
| 3,331,645 | A | * | 7/1967 | Vercellotti | A47B 49/002 211/74 |
| 4,528,825 | A | | 7/1985 | Khan | |
| 4,699,437 | A | | 10/1987 | Genereaux | |

(Continued)

FOREIGN PATENT DOCUMENTS

| | | | | |
|---|---|---|---|---|
| CN | 104976856 A | * | 10/2015 | F25D 25/02 |
| CN | 112484386 A | * | 3/2021 | F25D 25/02 |

(Continued)

*Primary Examiner* — Hiwot E Tefera
(74) *Attorney, Agent, or Firm* — Brooks Kushman P.C.

(57) ABSTRACT

A refrigerator shelving system includes a first shelf, a second shelf, and a slide member. The first shelf has ramped surfaces defining a guideway and a nest disposed within the guideway. The second shelf is suspended from the first shelf. The slide member is secured to the second shelf. The slide member is configured to slide linearly relative to the second shelf. The slide member has a protrusion extending outward therefrom. In response to upward forces acting on the second shelf, the protrusion engages the ramped surfaces and the nest to transition between operational and stowed positions.

20 Claims, 9 Drawing Sheets

(56) References Cited

U.S. PATENT DOCUMENTS 4,775,201 A * 10/1988 Thomson ..... F25D 25/021 312/249.7
5,329,865 A 7/1994 McWard
5,845,979 A * 12/1998 Longhurst ..... A47B 46/005 312/246
7,316,326 B2 1/2008 Kim et al.
7,618,103 B2 11/2009 Kim
7,740,332 B2 * 6/2010 Bassi ..... F25D 25/02 108/107
7,950,756 B2 5/2011 Collins et al.
8,376,482 B2 * 2/2013 An ..... F25D 25/02 312/408
8,851,306 B2 10/2014 Spurr et al.
10,408,531 B1 9/2019 Beck
11,435,133 B1 9/2022 Barik et al.
11,460,241 B1 * 10/2022 Chauhan ..... F25D 25/02
11,460,242 B1 * 10/2022 Swamulapalli ..... F25D 25/022
2004/0207305 A1 10/2004 Kim et al.
2006/0125362 A1 6/2006 Kim
2007/0228909 A1 * 10/2007 Hwang ..... F25D 31/007 312/408
2009/0058247 A1 * 3/2009 Collins ..... F25D 25/02 62/440
2014/0084123 A1 3/2014 Fields et al.
2014/0252937 A1 9/2014 Lee et al.
2017/0059236 A1 * 3/2017 Alyanak ..... F25D 11/00
2017/0295924 A1 10/2017 Getz
2020/0088460 A1 3/2020 Beck
2022/0257009 A1 * 8/2022 Taraka ..... A47B 96/025

FOREIGN PATENT DOCUMENTS

DE 102010039618 A1 2/2012
DE 10310804 B4 12/2019
JP H09250870 A * 9/1997 ..... F25D 25/02
WO 2012022653 A2 2/2012

* cited by examiner

REFRIGERATOR AND SHELVING SYSTEM FOR A REFRIGERATOR

CROSS-REFERENCE TO RELATED APPLICATIONS

This application is a continuation of U.S. application Ser. No. 17/580,989 filed Jan. 21, 2022, now U.S. Pat. No. 11,740,012, issued Aug. 29, 2023, the disclosure of which is hereby incorporated in its entirety by reference herein.

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelving system includes a first shelf, a second shelf, and a slide member. The first shelf has ramped surfaces defining a guideway and a nest disposed within the guideway. The second shelf is suspended from the first shelf. The slide member is secured to the second shelf. The slide member is configured to slide linearly relative to the second shelf. The slide member has a protrusion extending outward therefrom. In response to an upward force acting on the second shelf while the second shelf is in an operational position, (i) the second shelf travels upward and toward the first shelf, (ii) the protrusion is guided into the guideway, and (iii) the protrusion engages the ramped surfaces and the slide member slides relative to the second shelf such that the protrusion is guided to the nest to retain the second shelf in a stowed position. In response to an upward force acting on the second shelf while the second shelf is in the stowed position, (i) the protrusion engages the ramped surfaces and the slide member slides relative to the second shelf such that the protrusion is guided away from the nest and out of the guideway and (ii) the second shelf travels downward from the stowed position to the operational position.

A refrigerator shelving system includes an upper shelf, a plurality of hangers, a lower shelf, and sliding blocks. The upper shelf has a top plate and a pair of opposing side members extending downward from the top plate. Each of the side members define a guideway. Each guideway has a plurality of ramped surfaces and a nesting feature disposed therein. The plurality of hangers each have upper ends rotatably secured to at least one of the side members of the pair of opposing side members. The lower shelf is rotatably secured to lower ends of the plurality of hangers. The lower shelf defines slots along lateral side surfaces of the lower shelf. The sliding blocks are each disposed within one of the slots. The sliding blocks are each configured to slide linearly within the slots. The sliding blocks are each have protrusions extending laterally outward therefrom. In response to an upward force acting on the lower shelf while the lower shelf is in an operational position, (i) the lower shelf is rotated upward via the plurality of hangers to direct the protrusions into the guideways, and (ii) the protrusions engage a first portion of the ramped surfaces within the guideways, and the sliding blocks slide linearly within the slots, upon engagement between the protrusions and the first portion of the ramped surfaces such that the protrusions are guided to the nesting features and the lower shelf is retained in a stowed position via engagement between the protrusions and the nesting features. In response to an upward force acting on the lower shelf while the lower shelf is in the stowed position, (i) the protrusions engage a second portion of the ramped surfaces, and the sliding blocks slide within the slots, upon engagement between the protrusions and the second portion of the ramped surfaces such that the protrusions are guided away from the nesting features and out of the guideways and (ii) the lower shelf is rotated downward via the plurality of hangers from the stowed position to the operational position.

A refrigerator shelving system includes an upper shelf, at least one suspender, a lower shelf, and a block. The upper shelf has a side member. The side member has ramped surfaces defining a tortuous slot and a nest disposed within the tortuous slot. The at least one suspender is rotatably secured to the side member. The lower shelf is rotatably secured to a lower end of the at least one suspender. The block is slidably secured to the lower shelf and has a boss extending outward therefrom. In response to an upward force acting on the lower shelf while the lower shelf is in an operational position, (i) the lower shelf is rotated upward via the at least one suspender, (ii), the boss is guided into the tortuous slot, and (iii) the boss engages the ramped surfaces and the block slides relative to the lower shelf such that the boss is guided to the nest to retain the lower shelf in a stowed position via engagement between the boss and the nest. In response to an upward force acting on the lower shelf while the lower shelf is in the stowed position, (i) the boss engages the ramped surfaces and the block slides relative to the lower shelf such that the boss is guided away from the nest and out of the tortuous slot and (ii) the lower shelf is rotated downward via the at least one suspender from the stowed position to the operational position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
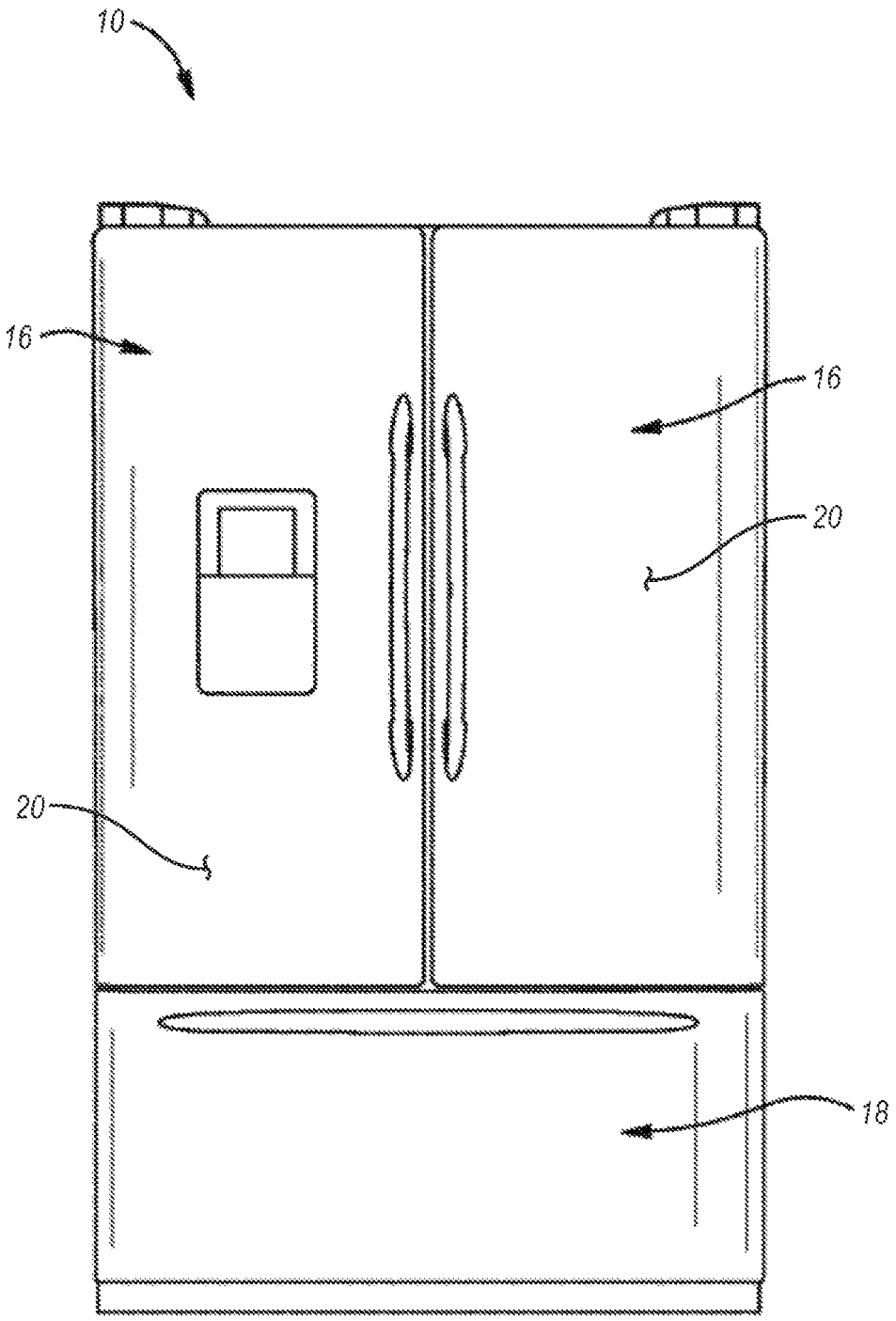
FIG. 1 is an elevated front view of a French-Door Bottom Mount type refrigerator appliance.
Figure 2:
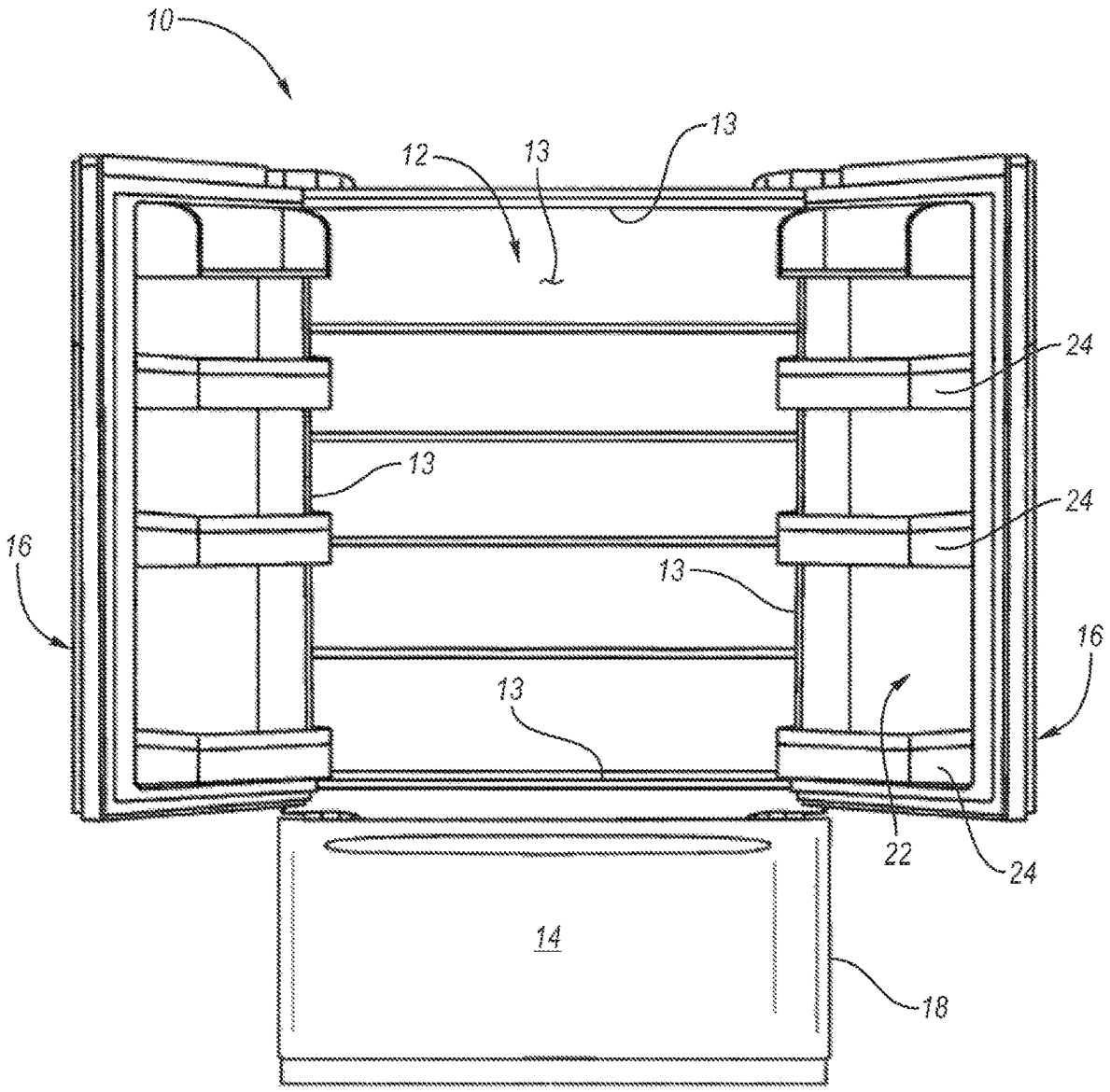
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or walls 13 that form a housing and define the fresh food compartment 12 and the freezer compartment 14. The walls 13 may more specifically form an internal liner of the refrigerator 10. The walls 13 may include a rear or back wall, a top wall, a bottom wall, and two side walls. One or more shelves may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Referring to FIGS. 3-7, a shelving system 26 for the refrigerator 10 is illustrated. The shelving system 26 may be disposed within the internal chamber (i.e., the fresh food compartment 12) of the refrigerator 10. A single shelving system 26 or multiple shelving systems that are identical to shelving system 26 may be disposed within the internal chamber of the refrigerator 10. It should be noted that any shelves illustrated in FIG. 2 may be removed or rearranged to create space for one or more of the shelving systems 26.

The shelving system 26 may include support arms 28 that engage one of the walls 13 that define the internal chamber 12 in order to secure the position of the shelving system 26 within the internal chamber 12. More specifically, hooks 30 defined along the end of the support arms 28 may extend into notches defined by the internal walls or liner of the refrigerator and may engage an internal wall or liner of the refrigerator within the notches to secure the position of the shelving system 26 within the internal chamber 12. The walls or liner of the refrigerator may define a plurality of vertically aligned notches so that the shelving system 26 can be adjusted upward or downward between notches in order to adjust a height of the shelving system 26 within the internal chamber 12.

The shelving system 26 includes an upper shelf 32 and a lower shelf 34. The upper shelf 32 and lower shelf 34 may also be referred to as first and second shelves. The upper shelf 32 has a top plate 36 and a pair of opposing side members 38 extending downward from the top plate 36. The top plate 36 is illustrated as being made from a transparent material, such as glass, but may be made from any desirable material. The upper shelf 32 has nesting features or nests 40 disposed along a bottom side of the upper shelf 32. More specifically, the nests 40 may extend laterally inward from the opposing side members 38.

One or more suspenders or hangers 42 are rotatably secured to the upper shelf 32. More specifically, the hangers 42 have upper ends 44 and each upper end 44 is rotatably secured to one the opposing side members 38. Rails 46 are suspended from the upper shelf 32 via the hangers 42. More specifically, the rails 46 may be rotatably secured to lower ends 48 of the hangers 42. Even more specifically, a front end and a rear end of each rail 46 may be rotatably secured to one of the lower ends 48 of one of the hangers 42. The rails 46 may comprise a pair of rails 46. Each of the rails 46 may be substantially parallel relative to each other. Substantially parallel may include any incremental angle that ranges between exactly parallel and 10° from exactly parallel.

The lower shelf 34 is slidably secured to the each of the rails 46. The lower shelf 34 and the rails 46 may include features that secure the lower shelf 34 to the rails 46 so that relative movement between the lower shelf 34 and the rails 46 is restricted to one direction. For example, (i) the bottom of the lower shelf 34 may define T-slots and (ii) the rails may be T-shaped and disposed within the T-slots (or vice versa) such that up and down movement and side to side movement of the lower shelf 34 relative to the rails 46 is restricted while forward and rearward movement of the lower shelf 34 relative to the rails 46 is allowed.

The lower shelf 34 has protrusions or bosses 50 extending laterally outward from each side of the lower shelf 34. Each of the bosses 50 are configured to engage one of the nests 40 to maintain the lower shelf 34 in a stowed position 52 (See FIG. 3). The lower shelf 34 and the rails 46 are collectively configured rotate upward and forward via the hangers 42 from an operational position 54 (See FIG. 5) to an intermediate position 56 (See FIG. 4). From the intermediate position 56, the lower shelf 34 is configured to slide rearward via the rails 46 from the intermediate position 56 to the stowed position 52 where each of the bosses 50 engage one of the nests 40 to maintain the lower shelf 34 in the stowed position 52. The stowed position 52, intermediate position 56, and operational position 54 may be referred to as the first, second, and third positions.

The lower shelf 34 is also configured to slide forward from the stowed position 52 to the intermediate position 56 via the rails 46 to disengage the bosses 50 from the nests 40. Once in the intermediate position 56 the lower shelf 34 is then configured to rotate downward and rearward via the hangers 42 to transition from the intermediate position 56 to the operational position 54. In the operational position 54, a space 58 is defined between the upper shelf 32 and the lower shelf 34 such that food items may be placed onto the lower shelf 34 (See FIG. 5). In the stowed position 52, the space 58 defined between the upper shelf 32 and the lower shelf 34 is reduced or eliminated such that food items may not be placed onto the lower shelf 34 (See FIG. 3). Transitioning the lower shelf 34 to the stowed position operates to increase the amount of available space for food items stored on a shelf that is just below the shelving system 26, which is desirable when large items are being stored in the refrigerator 10. The lower shelf 34, however, increases the capacity for storing smaller items when the lower shelf 34 is in the operational position 54.

The upper shelf 32 includes backstops 60 that are configured to engage the hangers 42 to limit rearward movement of the lower shelf 34 and retain the lower shelf 34 in the operational position 54. More specifically, the backstops 60 may extend laterally inward from the opposing side members 38.

Each nest 40 includes a cradle portion 62 that is configured to retain one of the bosses 50 while the lower shelf 32 is in the stowed position 52. The cradle portion 62 may have a palm or hand profile. More specifically, the cradle portion 62 may be circular with an open top. Each nest 40 also includes a ramp portion 64 configured to guide one of the bosses 50 toward a respective cradle portion 62 during a transition of the lower shelf 34 from the intermediate position 56 to the stowed position 52. Each ramp portion 64 may have a first ramp 66 that is inclined to initially push a respective boss 50 upward followed by a second ramp 68 that is declined to guide the respective boss 50 toward a respective cradle portion 62 during a transition of the lower shelf 34 from the intermediate position 56 to the stowed position 52.

Referring to FIGS. 8-10E, an alternative shelving system 126 for the refrigerator 10 is illustrated. The shelving system 126 may be disposed within the internal chamber (i.e., the fresh food compartment 12) of the refrigerator 10. A single shelving system 126 or multiple shelving systems that are identical to shelving system 126 may be disposed within the internal chamber of the refrigerator 10. It should be noted that any shelves illustrated in FIG. 2 may be removed or rearranged to create space for one or more of the shelving systems 126.

The shelving system 126 may include support arms 128 that engage one of the walls 13 that define the internal chamber 12 in order to secure the position of the shelving system 126 within the internal chamber 12. More specifically, hooks 130 defined along the end of the support arms 128 may extend into notches defined by the internal walls or liner of the refrigerator and may engage an internal wall or liner of the refrigerator within the notches to secure the position of the shelving system 126 within the internal chamber 12. The walls or liner of the refrigerator may define a plurality of vertically aligned notches so that the shelving system 126 can be adjusted upward or downward between notches in order to adjust a height of the shelving system 126 within the internal chamber 12.

The shelving system 126 includes an upper shelf 132 and a lower shelf 134. The shelving system 126. The upper shelf 132 and lower shelf 134 may also be referred to as first and second shelves. The upper shelf 132 has a top plate 136 and a pair of opposing side members 138 extending downward from the top plate 136. The top plate 136 is illustrated as being made from a transparent material, such as glass, but may be made from any desirable material. The upper shelf 132 has nesting features or nests 140 disposed along a bottom side of the upper shelf 132. More specifically, the nests 140 extend laterally inward from the opposing side members 138.

One or more suspenders or hangers 142 are rotatably secured to the upper shelf 132. More specifically, the hangers 142 have upper ends 144 and each upper end 144 is secured to one the opposing side members 138. The lower shelf 134 is suspended from the upper shelf 132 via the hangers 142. More specifically, lower shelf 134 may be rotatably secured to lower ends 148 of the hangers 142. Even more specifically, a front end and a rear end the lower shelf 134 may be rotatably secured to one of the lower ends 148 of one of the hangers 142.

Figure 8:
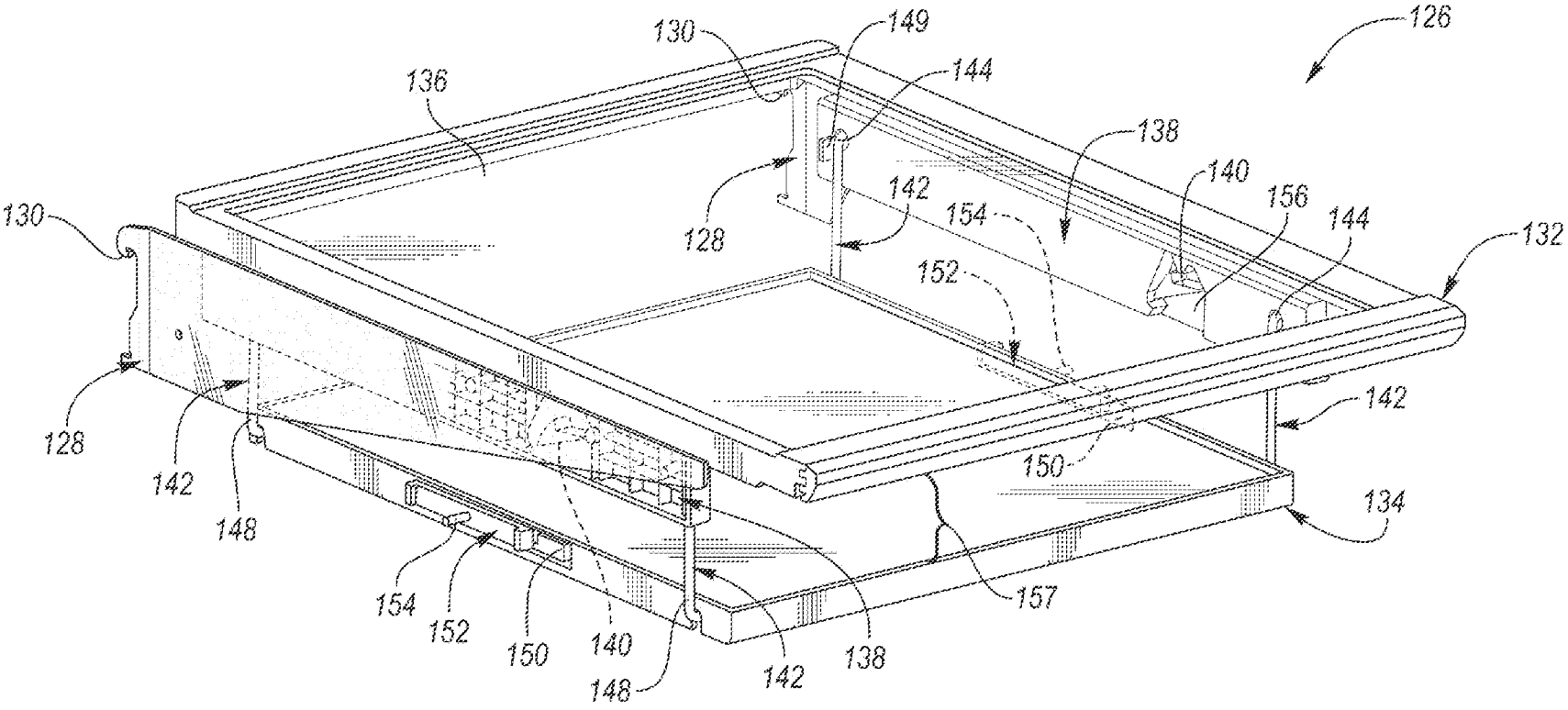
FIG. 8 is a top isometric view of an alternative shelving system for the refrigerator that includes upper and lower shelves with the lower shelf in the operational position.
Figure 9A:
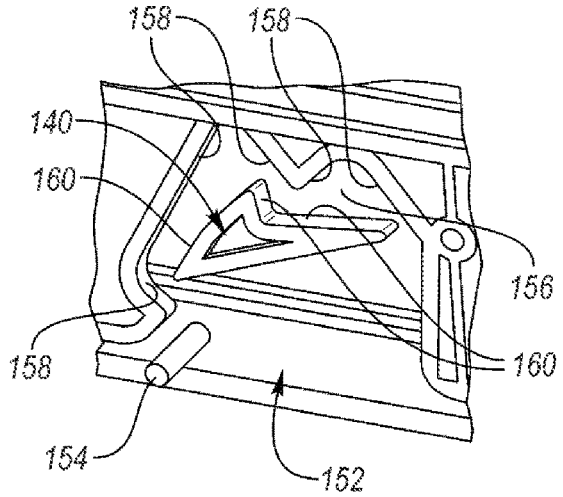
FIGS. 9A-9E illustrate a transition of the lower shelf of the alternative shelving system from the operational position to the stowed position.
Figure 9B:
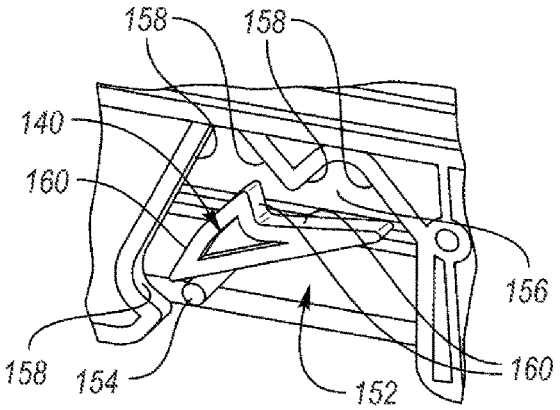
Figure 9C:
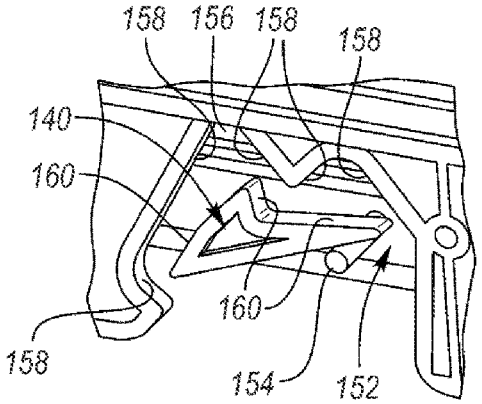
Figure 9D:
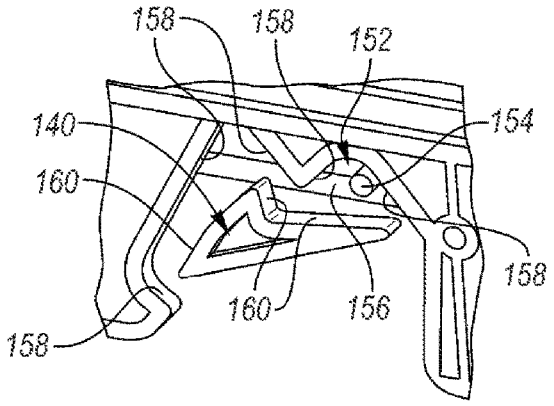
Figure 9E:
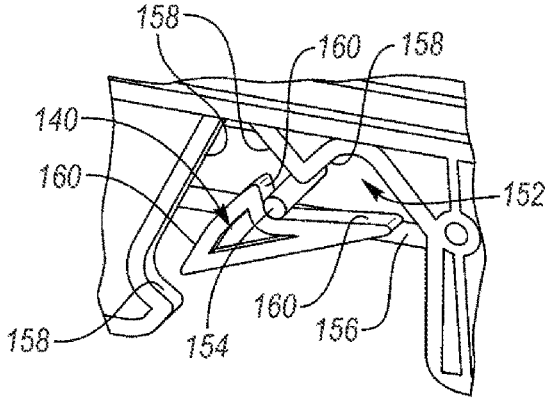
Figure 10A:
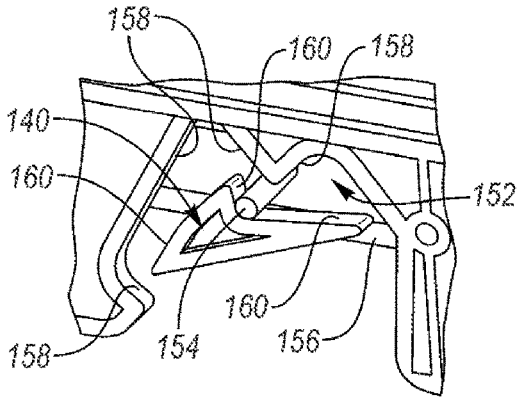
FIGS. 10A-10E illustrate a transition of the lower shelf of the alternative shelving system from the stowed position to the operational position.
Figure 10B:
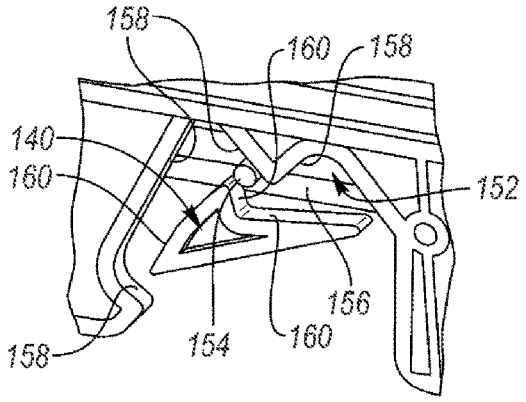
Figure 10C:
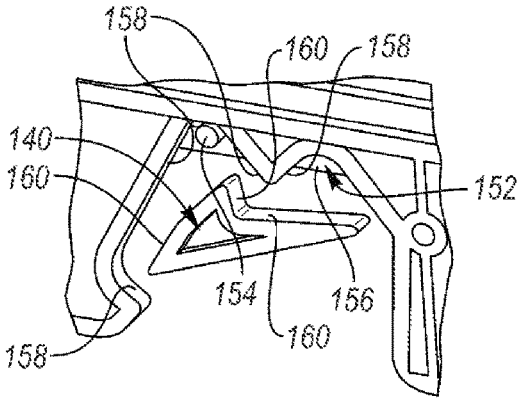
Figure 10D:
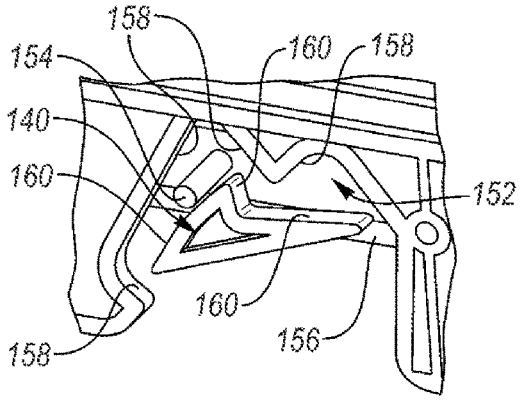
Figure 10E:
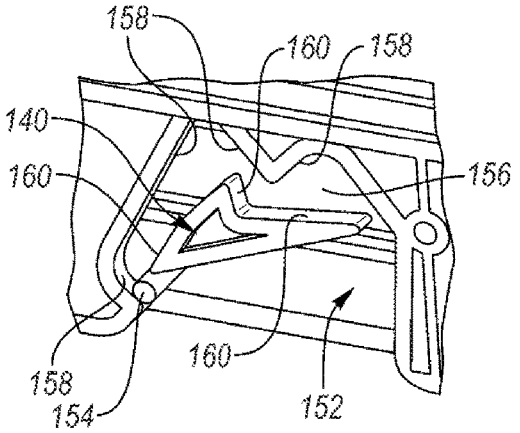

The upper shelf 132 includes backstops 149 that are configured to engage the hangers 142 to limit rearward movement of the lower shelf 134 and retain the lower shelf 134 in an operational position (See FIG. 8). More specifically, the backstops 149 may extend laterally inward from the opposing side members 138. In the operational position, a space 157 is defined between the upper shelf 132 and the lower shelf 134 such that food items may be placed onto the lower shelf 134.

The lower shelf 134 defines slots 150 along lateral side surfaces of the lower shelf 134. Sliding members or sliding blocks 152 (i) are disposed within each of the slots 150, (ii) are configured to slide linearly within the slots 150 between a front end and a rear end of the lower shelf 134, and (iii) have protrusions or bosses 154 extending laterally outward therefrom. Each of the side members 138 define an opening or guideway 156. The guideway 156 has a plurality of ramped surfaces 158 and one of the nests 140 disposed within each guideway 156. The nests 140 also include ramped surfaces 160.

In response to an upward force acting on the lower shelf 134 while the lower shelf 134 is in the operational position, which is below and spaced apart from the upper shelf 132, (i) the lower shelf 134 is rotated upward via the plurality of hangers 142 to direct the bosses 154 into the guideways 156, and (ii) the bosses 154 engage a first portion of the ramped surfaces 158, 160 within the guideways 156 and the sliding blocks 152 slide linearly within the slots 150 upon engagement between the bosses 154 and the first portion of the ramped surfaces 158, 160 such that the bosses 154 are guided to the nests 140 and the lower shelf 132 is retained in a stowed position (see FIG. 9E) via engagement between the bosses 154 and the nests 140. Such a sequence of engagement between the bosses 154 and the ramped surfaces 158, 160 within the guideways 156 during a transition from the operational position to the stowed position is illustrated in FIGS. 9A-9E.

Figure 3:
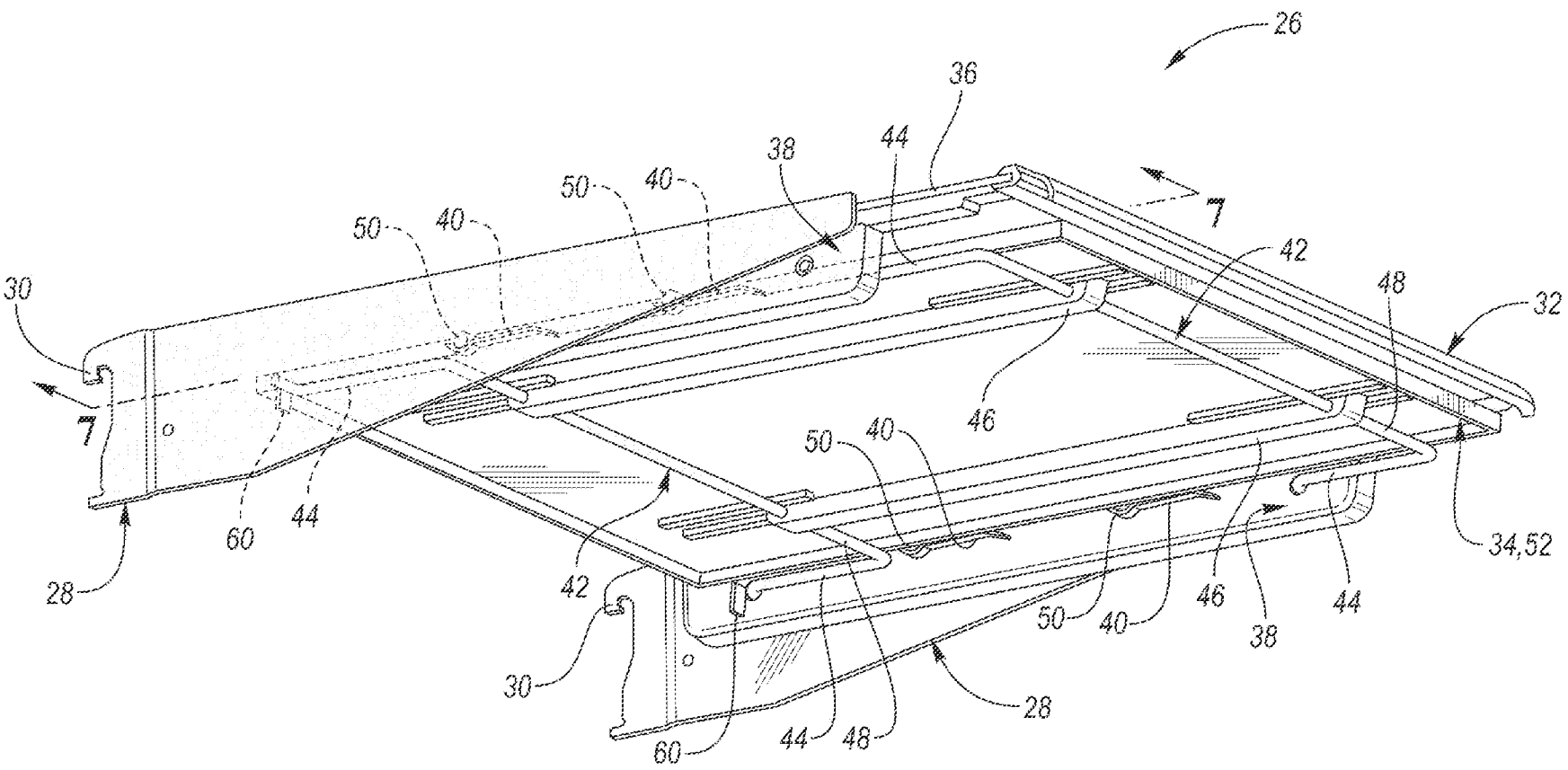
FIG. 3 is a bottom isometric view of a shelving system for the refrigerator that includes upper and lower shelves with the lower shelf in a stowed position.
Figure 4:
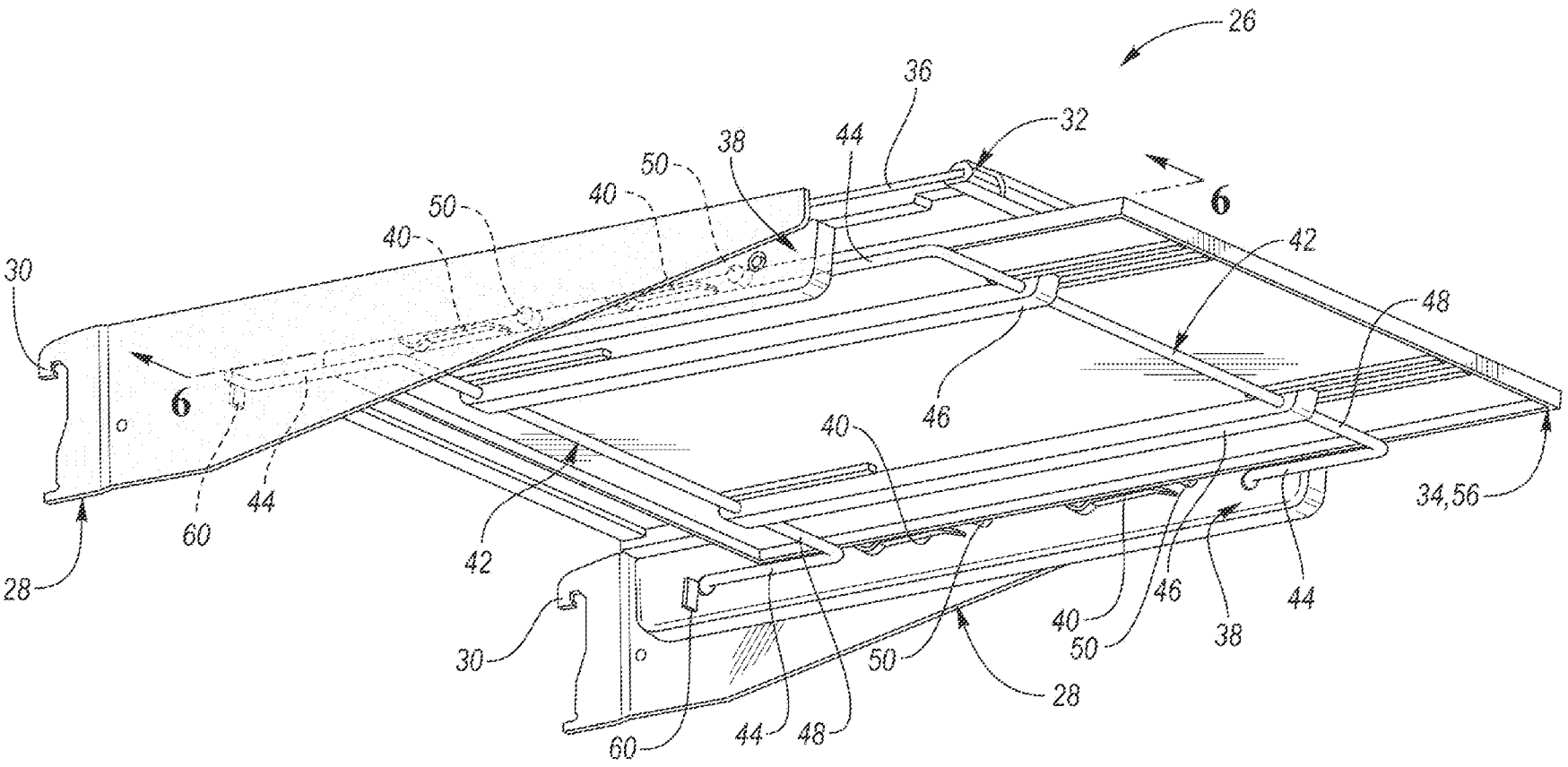
FIG. 4 is a bottom isometric view of the shelving system for the refrigerator with the lower shelf in an intermediate position.
Figure 5:
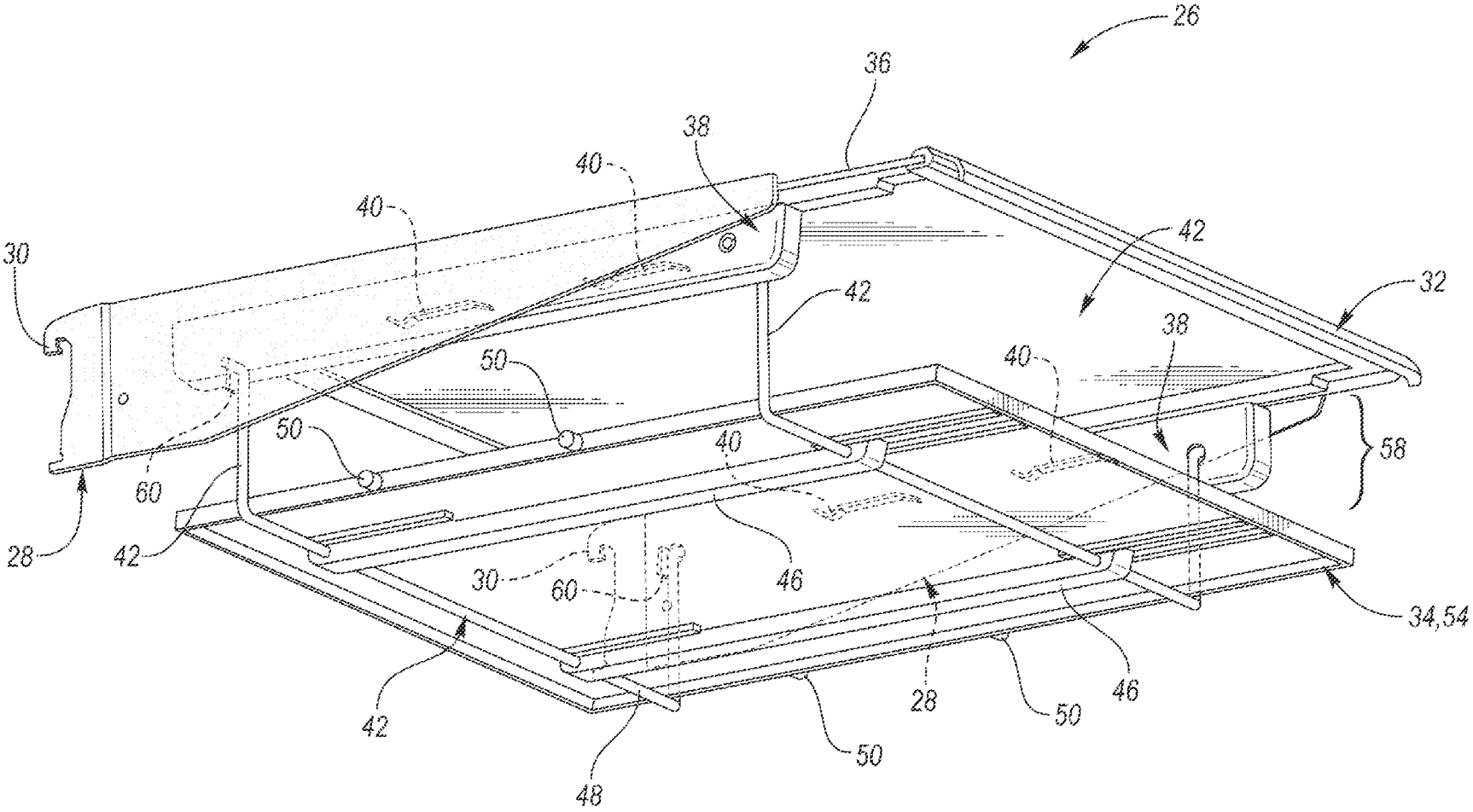
FIG. 5 is a bottom isometric view of the shelving system for the refrigerator with the lower shelf in an operational position.
Figure 6:
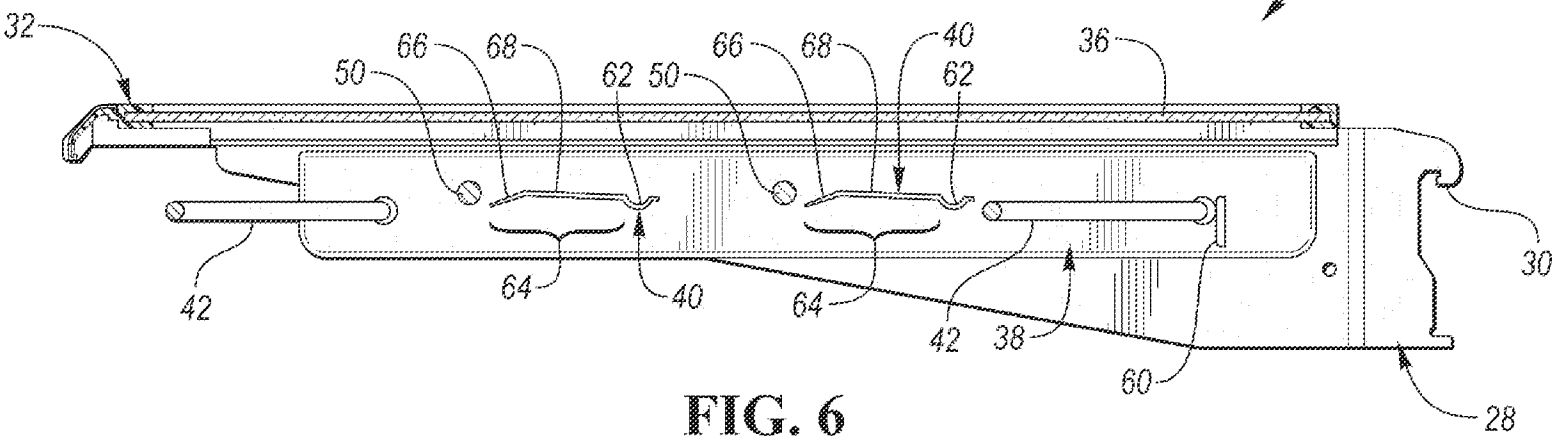
FIG. 6 is a cross-sectional view taken along line 6-6 in FIG. 4.
Figure 7:
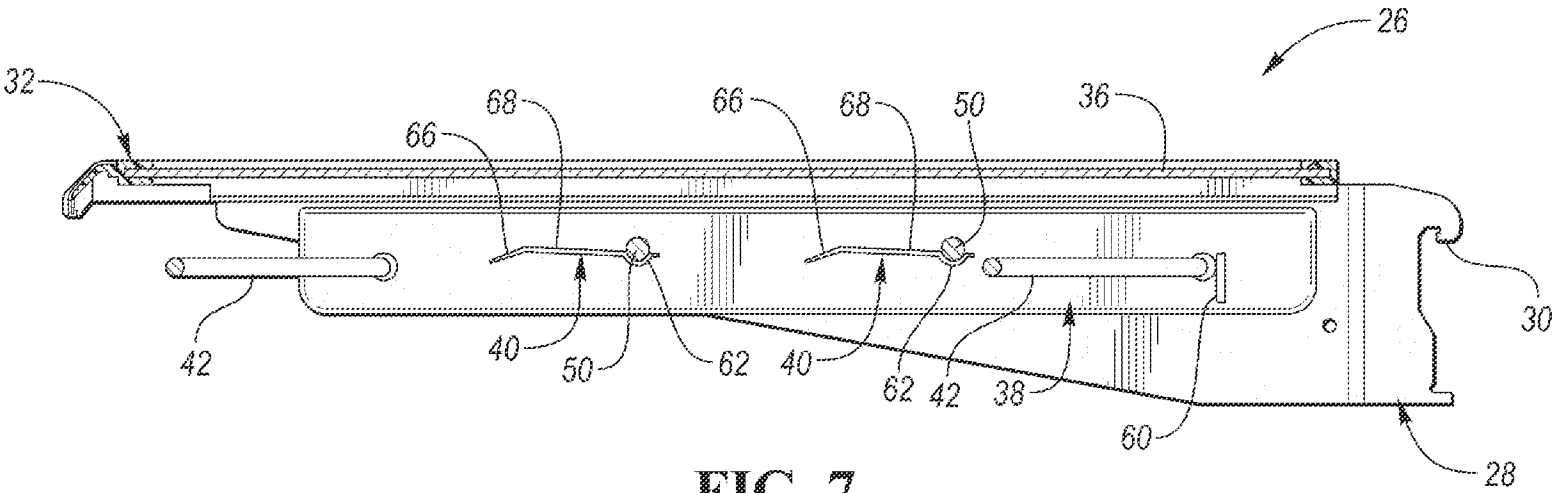
FIG. 7 is a cross-sectional view taken along line 7-7 in FIG. 3.

The stowed position of the lower shelf 134 may be similar to and include all the characteristics of the stowed position of the lower shelf 34 illustrated in FIG. 3. The lower shelf 134 is below and adjacent to the upper shelf 132 in the stowed position, and the space 157 defined between the upper shelf 132 and the lower shelf 134 is reduced or eliminated such that food items may not be placed onto the lower shelf 134 when the lower shelf 134 is in the stowed position.

In response to an upward force acting on the lower shelf 134 while the lower shelf 134 is in the stowed position, (i) the bosses 154 engage a second portion of the ramped surfaces 158, 160 and the sliding blocks 152 slide within the slots 150 upon engagement between the bosses 154 and the second portion of the ramped surfaces 158, 160 such that the bosses 154 are guided away from the nests 140 and out of the guideways 156 and (ii) the lower shelf 134 is rotated downward via the plurality of hangers 142 from the stowed position to the operational position upon the bosses 154 exiting the guideways 156. Such a sequence of engagement between the bosses 154 and the ramped surfaces 158, 160 within the guideways 156 during a transition from the stowed position to the operational position is illustrated in FIGS. 10A-10E. Since an upward force is utilized to transition the lower shelf 134 to both the stowed position and the operational position, the mechanism utilized to transition the lower shelf 134 between the stowed position and the operational position may be referred to as a push-push mechanism.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelving system comprising:

a first shelf having (i) ramped surfaces defining a guideway and (ii) a nest disposed within the guideway;

a second shelf suspended from the first shelf; and a slide member (i) secured to the second shelf, (ii) configured to slide linearly relative to the second shelf, and (iii) having a protrusion extending outward therefrom, wherein in response to an upward force acting on the second shelf while the second shelf is in an operational position, (i) the second shelf travels upward and toward the first shelf, (ii) the protrusion is guided into the guideway, and (iii) the protrusion engages the ramped surfaces and the slide member slides relative to the second shelf such that the protrusion is guided to the nest to retain the second shelf in a stowed position, and wherein in response to an upward force acting on the second shelf while the second shelf is in the stowed position, (i) the protrusion engages the ramped surfaces and the slide member slides relative to the second shelf such that the protrusion is guided away from the nest and out of the guideway and (ii) the second shelf travels downward from the stowed position to the operational position.

2. The refrigerator shelving system of claim 1, wherein a first portion of the ramped surfaces are configured to guide the protrusion (i) upward and laterally over the nest and (ii) downward and onto the nest to transition the second shelf from the operational position to the stowed position.

3. The refrigerator shelving system of claim 2, wherein a second portion of the ramped surfaces are configured to guide the protrusion (i) upward and laterally away from the nest and (ii) downward and out of the guideway to transition the second shelf from the stowed position to the operational position.

4. The refrigerator shelving system of claim 1, wherein a portion of the ramped surfaces are defined along an exterior of the nest.

5. The refrigerator shelving system of claim 4, wherein the portion of the ramped surfaces cradle the protrusion when the first shelf is in the stowed position.

6. The refrigerator shelving system of claim 1, wherein the second shelf is positioned below and adjacent to the first shelf in the stowed position.

7. The refrigerator shelving system of claim 1, wherein the second shelf is positioned below and spaced apart from the first shelf in the operational position.

8. A refrigerator shelving system comprising:

an upper shelf having a top plate and a pair of opposing side members extending downward from the top plate, each of the side members defining a guideway, wherein each guideway has (i) a plurality of ramped surfaces and (ii) a nesting feature disposed therein;

a plurality of hangers, each having upper ends rotatably secured to at least one of the side members of the pair of opposing side members;

a lower shelf (i) rotatably secured to lower ends of the plurality of hangers and (ii) defining slots along lateral side surfaces of the lower shelf; and sliding blocks, each (i) disposed within one of the slots, (ii) configured to slide linearly within the slots, and (iii) having protrusions extending laterally outward therefrom, wherein in response to an upward force acting on the lower shelf while the lower shelf is in an operational position, (i) the lower shelf is rotated upward via the plurality of hangers to direct the protrusions into the guideways, and (ii) the protrusions engage a first portion of the ramped surfaces within the guideways and the sliding blocks slide linearly within the slots upon engagement between the protrusions and the first portion of the ramped surfaces such that the protrusions are guided to the nesting features and the lower shelf is retained in a stowed position via engagement between the protrusions and the nesting features, and wherein in response to an upward force acting on the lower shelf while the lower shelf is in the stowed position, (i) the protrusions engage a second portion of the ramped surfaces and the sliding blocks slide within the slots upon engagement between the protrusions and the second portion of the ramped surfaces such that the protrusions are guided away from the nesting features and out of the guideways and (ii) the lower shelf is rotated downward via the plurality of hangers from the stowed position to the operational position.

9. The refrigerator shelving system of claim 8, wherein the first portion of the ramped surfaces are configured to guide the protrusions (i) upward and laterally over the nesting features and (ii) downward and onto the nesting features to transition the lower shelf from the operational position to the stowed position.

10. The refrigerator shelving system of claim 8, wherein the second portion of the ramped surfaces are configured to guide the protrusions (i) upward and laterally away from the nesting features and (ii) downward and out of the guideways to transition the lower shelf from the stowed position to the operational position.

11. The refrigerator shelving system of claim 8, wherein a third portion of the ramped surfaces are defined along exteriors of the nesting features.

12. The refrigerator shelving system of claim 11, wherein the third portion of the ramped surfaces cradle the protrusions when the lower shelf is in the stowed position.

13. The refrigerator shelving system of claim 8, wherein the lower shelf is positioned below and adjacent to the upper shelf in the stowed position.

14. The refrigerator shelving system of claim 8, wherein the lower shelf is positioned below and spaced apart from the upper shelf in the operational position.

15. A refrigerator shelving system comprising:

an upper shelf having a side member, the side member having (i) ramped surfaces defining a tortuous slot and (ii) a nest disposed within the tortuous slot;

at least one suspender rotatably secured to the side member;

a lower shelf rotatably secured to a lower end of the at least one suspender; and a block (i) slidably secured to the lower shelf and (ii) having a boss extending outward therefrom, wherein in response to an upward force acting on the lower shelf while the lower shelf is in an operational position, (i) the lower shelf is rotated upward via the at least one suspender, (ii), the boss is guided into the tortuous slot, and (iii) the boss engages the ramped surfaces and the block slides relative to the lower shelf such that the boss is guided to the nest to retain the lower shelf in a stowed position via engagement between the boss and the nest, and wherein in response to an upward force acting on the lower shelf while the lower shelf is in the stowed position, (i) the boss engages the ramped surfaces and the block slides relative to the lower shelf such that the boss is guided away from the nest and out of the tortuous slot and (ii) the lower shelf is rotated downward via the at least one suspender from the stowed position to the operational position.

16. The refrigerator shelving system of claim 15, wherein a first portion of the ramped surfaces are configured to guide the boss (i) upward and laterally away from the nest and (ii) downward and out of the tortuous slot to transition the lower shelf from the stowed position to the operational position.

17. The refrigerator shelving system of claim 16, wherein a second portion of the ramped surfaces are configured to guide the boss (i) upward and laterally over the nest and (ii) downward and onto the nest to transition the lower shelf from the operational position to the stowed position.

18. The refrigerator shelving system of claim 15, wherein a portion of the ramped surfaces are defined along an exterior of the nest.

19. The refrigerator shelving system of claim 18, wherein the portion of the ramped surfaces cradle the boss when the lower shelf is in the stowed position.

20. The refrigerator shelving system of claim 15, wherein the lower shelf is (i) positioned below and adjacent to the upper shelf in the stowed position and (ii) positioned below and spaced apart from the upper shelf in the operational position.

* * * * *